US009956442B2

(12) United States Patent
Cooper et al.

(10) Patent No.: US 9,956,442 B2
(45) Date of Patent: May 1, 2018

(54) FIRE AND/OR SMOKE BARRIER

(71) Applicant: COOPERS FIRE LIMITED, Havant, Hampshire (GB)

(72) Inventors: Andrew Paul Cooper, Rowlands Castle (GB); James Martin Reed, Alverstoke (GB)

(73) Assignee: Coopers Fire Limited

( * ) Notice: Subject to any disclaimer, the term of this patent is extended or adjusted under 35 U.S.C. 154(b) by 0 days. days.

(21) Appl. No.: 14/773,357

(22) PCT Filed: Mar. 5, 2014

(86) PCT No.: PCT/GB2014/050639
§ 371 (c)(1),
(2) Date: Sep. 7, 2015

(87) PCT Pub. No.: WO2014/135863
PCT Pub. Date: Sep. 12, 2014

(65) Prior Publication Data

US 2016/0193488 A1 Jul. 7, 2016

Related U.S. Application Data

(60) Provisional application No. 61/843,476, filed on Jul. 8, 2013.

(30) Foreign Application Priority Data

Mar. 7, 2013 (GB) ..... 1304316.1

(51) Int. Cl.
*A62C 2/10* (2006.01)
*E06B 5/00* (2006.01)
(Continued)

(52) U.S. Cl.
CPC ..... *A62C 2/10* (2013.01); *E06B 5/00* (2013.01); *E06B 9/56* (2013.01); *E06B 9/42* (2013.01)

(58) Field of Classification Search
CPC .... A62C 2/10; A62C 2/06; A62B 3/00; E04B 1/94; E04B 1/946; E04B 1/947; E04B 1/948; E06B 9/52; E06B 7/32
(Continued)

(56) References Cited

U.S. PATENT DOCUMENTS 1,683,844 A * 9/1928 Neveu ..... E06B 9/58 160/275
4,712,598 A * 12/1987 Bonacci ..... E06B 9/262 160/327
(Continued)

FOREIGN PATENT DOCUMENTS

GB 2332860 7/1999

*Primary Examiner* — Chee-Chong Lee
(74) *Attorney, Agent, or Firm* — Jennifer Meredith, Esq.; Meredith & Keyhani, PLLC

(57) ABSTRACT

A curtain is wound on a roller (2), provided in a head box (4), mounted in a ceiling (6). The curtain is also provided with a bottom bar (10). When the curtain is drawn up onto the roller, the bottom bar (10) can be used to close the head box (4). When deployed the bottom bar provides stability to the descending curtain, and in full deployment rests on the floor. The curtain is provided with additional strips (30) of fabric, to allow ease of roll up onto the roller. The strip(s) arc attached at their top end only, to the curtain. Typically this will be by sewing (32), but also may be rivets or other form of heat resistant connection. The strip(s) are also connected to the bottom bar. A cable (34) is attached to the strip(s), usually through a rivet, but any other form of secure attachment may be used. The cable is then connected to the
(Continued)

Figure 1:
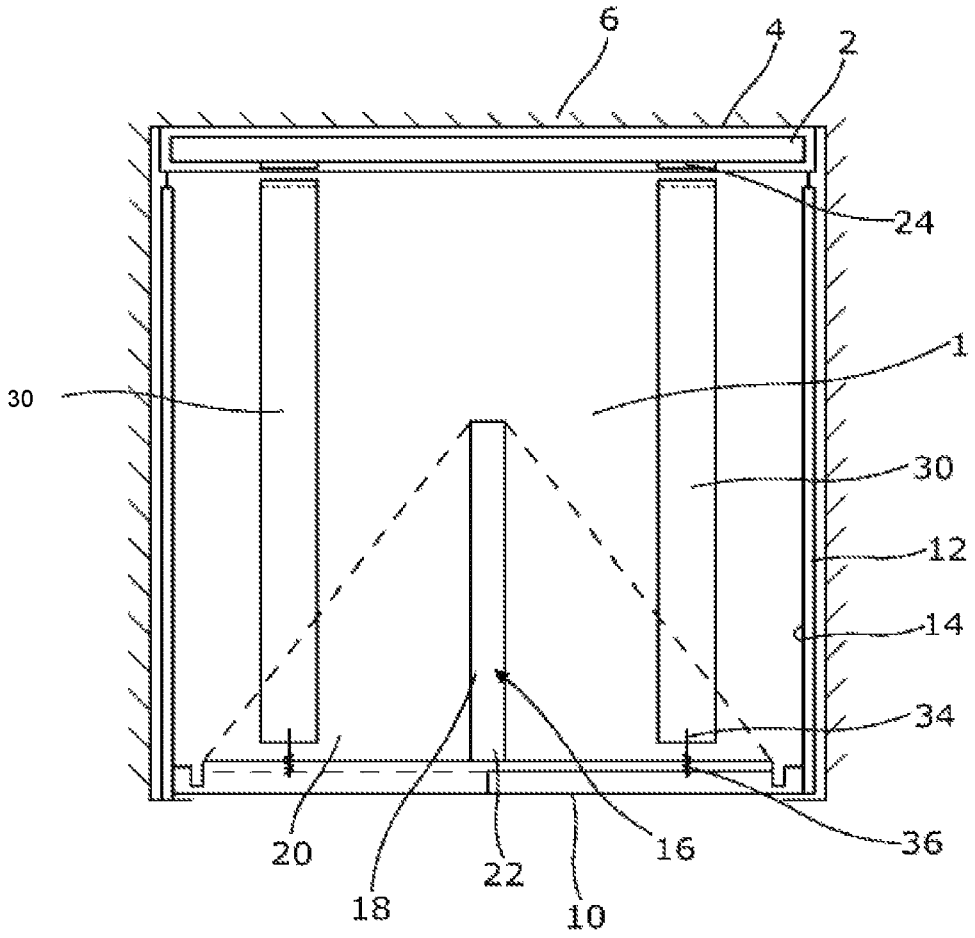

bottom bar, via a spring (36). This connects to keep the strip(s) in tension, to enable ease of rolling of the curtain.

12 Claims, 2 Drawing Sheets

(51) Int. Cl.
*E06B 9/56* (2006.01)
*E06B 9/42* (2006.01)

(58) Field of Classification Search
USPC ..... 169/48; 160/70, 74, 77, 79, 82, 84.09, 160/84.11, 160, 165, 187, 199, 180, 238, 160/1–9
See application file for complete search history.

(56) References Cited

U.S. PATENT DOCUMENTS 4,782,674 A * 11/1988 Johnson ..... E05B 47/0002 292/220
5,271,449 A * 12/1993 Herrick ..... E06B 9/521 160/354
5,445,209 A * 8/1995 Lichy ..... E06B 9/13 160/273.1
5,704,663 A * 1/1998 Clay, Jr. ..... E05B 65/0021 292/122
5,720,333 A * 2/1998 Turvey ..... E05B 47/0002 160/290.1

* cited by examiner

FIRE AND/OR SMOKE BARRIER

This application is a national stage under 35 U.S.C. 371 of International Application No. PCT/GB2014/050639 filed Mar. 5, 2014 which claims priority to and the benefit of United Kingdom patent application number 1304316.1 filed Mar. 7, 2013.

The present invention relates to smoke and fire barriers and particularly although not exclusively to barriers with curtains designed to cover a particularly wide expanse, or having egress openings.

Smoke and fire barriers are intended to contain smoke, fire, or smoke and fire. In certain applications, fire barriers are required. In others, the fire barrier must also limit smoke. Whereas in others still, the lower temperature task of restricting smoke from flowing throughout a building or other construction is adequate. Insofar as heat and smoke rises it may not be necessary for a smoke barrier to extend from a ceiling all the way to the floor. For instance at an atrium, a smoke curtain dropping from the ceilings around the atrium can contain the smoke to prevent lateral migration and ensure it rises up the atrium to be extracted at a higher level. However, where the barrier is a fire barrier, it must extend to close an opening.

The differences in the requirements for the curtains, in addition to the width that they are required to cover, results in curtains of different weights. For example fire curtains are typically thicker and heavier than smoke curtains, having to withstand higher temperatures. Wide curtains, that is curtains having a considerable lateral extent, can be too heavy for deployment from a single, unsupported roller, because the roller does not have sufficient stiffness to support the weight of the curtain. It is known to provide intermediate bearings or supports for the roller. However, the curtain passing over these supports causes considerable wear on the curtain, reducing its fire and smoke barrier performance. As a result a thick curtain material is generally used with rollers supported on additional bearings or supports, to reduce damage to the curtain.

In addition, curtains can be provided with egress openings, to allow persons trapped on the wrong side of the curtain to pass through. Such egress openings result in curtains having one or more areas of double thickness to provide openable attachment of two parts of the curtain. This also creates difficulties in the smooth rolling of the curtain onto the roller, with the additional material unbalancing the curtain.

The object of the present invention is to provide an improved fire and/or smoke barrier.

According to the invention there is provided a barrier comprising:

a roller, a curtain for rolling onto and deployment from the roller;

a bottom bar, attached to the bottom of the curtain, for weighting the curtain for deployment to the floor the curtain having at least one strip of material connected to an upper portion on the curtain and extending substantially the length of the curtain, the strip(s) being attached to the curtain at their top end(s), and connected to the bottom bar at their lower end(s), the connection including tensioning means.

If the roller is for a wide expanse and is provided with addition supports, typically in the form of support cradles, the strip(s) may be provided in alignment with these supports.

Usually the strip(s) will be made from the same material as the curtain. However, other fire-resistant material may alternatively be used.

Preferably the connection to the bottom bar will include a cable and a spring.

Typically the strip(s) will be connected to the curtain by stitching, with heat resistant thread. However, alternatively the strips can be attached using rivets or other mechanical connection means.

Where the curtain is provided with egress openings, the strip(s) can be used to balance the curtain. Typically several strip(s) will be provided, one above the other, providing a thicker section.

Figure 2:
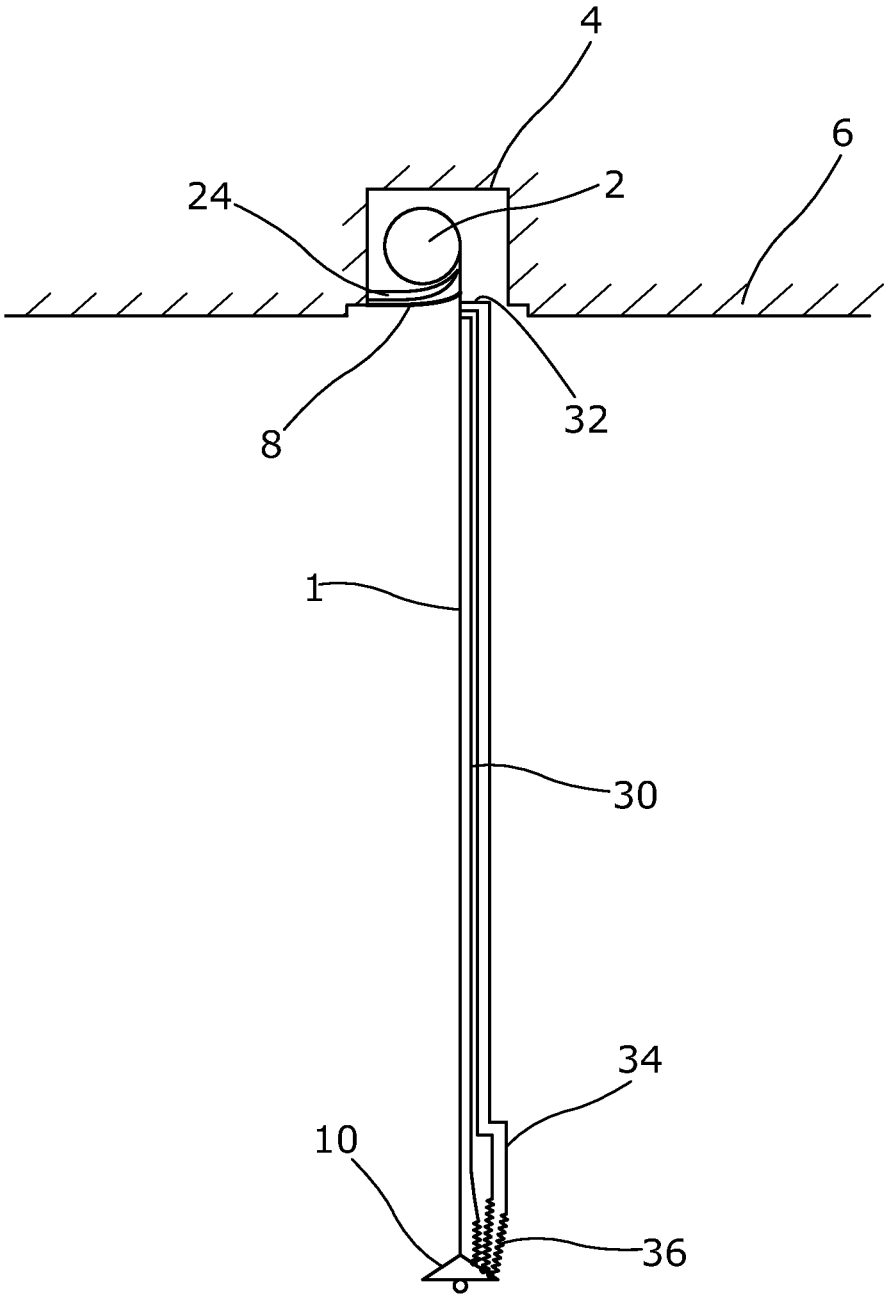

To help the understanding of the invention, a specific embodiment thereof will now be described by way of example and with reference to the accompanying drawings, in which:

FIG. 1 is a front view of a fire curtain according to the present invention; and FIG. 2 is a cross-sectional view of the fire curtain of FIG. 1.

Referring to FIG. 1, the curtain 1 there shown is designed to cover a wide expanse, typically 1.5-18 m with a drop of 4-6 m. However, the invention also relates to fire and smoke curtain of any dimensions.

The curtain is made of a fire resistant fabric such as EFP 4/1000 or EFP 2/1000/SS, both of which are available from Coopers Fire Ltd, Havant, England, although other fire resistant materials can also be used. These materials are woven glass fibre, reinforced with stainless steel.

When not deployed, the curtain is wound on a roller 2, provided in a head box 4, mounted in a ceiling 6. The head box is provided with a seal 8 positioned to bear against the curtain 1 when the latter is deployed to prevent any smoke flow path through the head box and roller.

The curtain is also provided with a bottom bar 10. When the curtain is wound up onto the roller, the bottom bar 10 can be used to close the head box 4. When deployed the bottom bar provides stability to the descending curtain, and in full deployment rests on the floor, where it may be locked into position, typically by electromechanical latches or other mechanical devices (not shown).

Side guides 12 are also provided to contain the side edges 14 of the curtain. They extend from the head box on the ceiling to the floor, and have in-turned lips (not shown) between which the edges of the curtain are held.

The curtain is provided with an egress door 16, to allow person to pass through the curtain after deployment, to prevent them from being trapped on the fire side of the curtain. As shown the curtain 1 is provided with an opening 18, the flaps 20 on either side of the opening are provided with hook and loop fastening tapes 22, to provide and overlap and to hold the opening closed under normal operational conditions. The tapes are high temperate resistant. In addition the sections of the bottom bar corresponding to the openable sections 20 of the curtain, are separated from the rest of the bottom bar. This enables the sections to move away to allow the egress door to open. Should a person be trapped on the wrong side of the curtain when deployed, pressure on the curtain will cause the hook and loop fastening to release and open the opening to allow the person to pass through. Once the person has passed through the curtain, the weight of the displaced bottom bar section will act to close and reseal the opening.

The curtain 1 covers a wide expanse, and as such the roller is supported on support cradles 24 at intervals along its length. As shown, the roller is provided with two support cradles, although more support cradles made by used, depending upon the width of the expanse and the weight of the curtain, which depends at least in part on its length.

As the curtain is deployed and re-rolled onto the roller the curtain fabric passes over the cradles, which causes additional wear on the curtain, and also results in uneven rolling into the head box. In addition, the presence of the opening causes further difficulty and unevenness in the rolling of the curtain.

In accordance with the present invention, the curtain is provided with additional strip(s) 30 of fabric, which act to balance the curtain and allow ease of roll up onto the roller.

The strips 30 may be made of the same fabric as the curtain, however they may also be made from an alternative fire resistant fabric. For example the strips may be made of EFP 2/1000/DGI, available from Coopers Fire Ltd, Havant England. This fabric is a woven glass fibre, stainless steel reinforced fabric, with an intumescent graphite silicone elastomer. This is slightly thicker material than that of the curtain, providing a slight cushioning effect.

These strip(s) 30 are provided at positions that correspond to the support cables 18 and thus also act to prevent wear on the curtain.

It is important that the strip(s) roll up cleanly with the main curtain material, and thus it is important that they are free to roll with the curtain. The strip(s) are therefore attached at their top end only, to the curtain. Typically this will be by sewing 32, but also may be rivets or other mechanical connection means of heat resistant connection. The strips are also connected to the bottom bar. A cable 34 is attached to the strip(s), usually through a rivet or other mechanical connection means to secure attachment. The cable is then connected to the bottom bar, via a spring 36. This connection keeps the strip(s) in tension, to enable ease of rolling of the curtain. Any other form of attachment can be used which maintain tension on the strip but are heat resistant.

To achieve balance of the curtain typically one or more strip(s) will be used at each position, the strip(s) provided are essentially on top of each other. While they could be stitched, or otherwise connected at their upper ends to the curtain together, usually they will be connected separately, one above the other along the height of the curtain. However they are connected to the curtain, they will be individually connected to the bottom bar. Where the strip(s) are used in conjunction with egress openings, they are positioned at a height to match that of the egress openings. This enables the curtain to be balanced.

On installation of the curtain, the head box 4, side guides 12 and curtain are fitted as usual, with the strip(s) attached to the curtain at their top end, but not connected at the lower ends. Once the curtain is fitted, it is rolled onto the roller 2, with the strip(s) un-connected to the bottom bar. When the curtain is almost fully on the roller the strip(s) are marked at the position where they would meet the bottom bar. The curtain in then un-rolled, and the strip(s) allowed to hang free. At this point they must be cut where marked, which will equate to a few centimeters above the bottom bar. They are then attached to the bottom bar individually, using tensioning means described above.

The invention is not intended to be restricted to the details of the above-described embodiment. For instance, the curtain can be provided with a different type of egress opening, for example one in which multiple egress openings are provided.

The invention claimed is:

1. A fire and/or smoke barrier comprising:

a roller;

a curtain for rolling onto and deployment from the roller;

a bottom bar, attached to the bottom of the curtain, for weighting the curtain for deployment to a floor, wherein:

the curtain includes at least one strip of additional material connected to an upper portion on the curtain, wherein the at least one strip of additional material extends for a drop of the curtain and is connected to the bottom bar by tensioning means and wherein the tensioning means are connected to the at least one strip of additional material only at the bottom, and the roller is provided with at least one support aligned with the at least one strip of additional material for locally supporting the weight of the rolled curtain via the at least one strip of additional material.

2. A fire and/or smoke barrier according to claim 1, wherein the at least one support is a resilient cradle.

3. A fire and/or smoke barrier according to claim 1, wherein the tensioning means is created by a spring connected between a bottom of the at least one strip of additional material and the bottom bar.

4. A fire and/or smoke barrier according to claim 1, wherein the at least one strip of additional material is attached to the curtain at their top end(s) only.

5. A fire and/or smoke barrier according to claim 1, wherein the at least one strip of additional material is from the same material as the curtain or other fire-resistant material.

6. A fire and/or smoke barrier according to claim 1, wherein the at least one strip of additional material is connected to the curtain by stitching, with heat resistant thread.

7. A fire and/or smoke barrier according to claim 1, wherein the at least one strip of additional material is attached using rivets.

8. A fire and/or smoke barrier according to claim 1, wherein:

the curtain has with an egress opening(s) and a respective one of the at least one strip of additional material is provided at each side of the egress opening.

9. A fire and/or smoke barrier according to claim 1, wherein the at least one strip of additional materials is at least two strips of additional material that extend to overlap each other.

10. A fire and/or smoke barrier according to claim 9, wherein the at least one strip of additional materials is at least two strips of additional material that extend to overlap each other and are connected to the bottom bar.

11. A fire and/or smoke barrier according to claim 1, wherein the tensioning means is created by a spring connected between the bottom of the at least one strip of additional material and the bottom bar via a cable.

12. A fire and/or smoke barrier according to claim 1, wherein that at least one strip of additional material connected to an upper portion on the curtain is made from an additional material from that of the curtain.

* * * * *